US009868023B2

(12) United States Patent
Boykin

(10) Patent No.: US 9,868,023 B2
(45) Date of Patent: Jan. 16, 2018

(54) SLIDING EXERCISE DEVICE WITH A PLURALITY OF TRACKS

(71) Applicant: James Darryl Boykin, Clifton, VA (US)

(72) Inventor: James Darryl Boykin, Clifton, VA (US)

( * ) Notice: Subject to any disclaimer, the term of this patent is extended or adjusted under 35 U.S.C. 154(b) by 78 days.

(21) Appl. No.: 14/613,586

(22) Filed: Feb. 4, 2015

(65) Prior Publication Data

US 2015/0217160 A1 Aug. 6, 2015

Related U.S. Application Data

(60) Provisional application No. 61/936,714, filed on Feb. 6, 2014.

(51) Int. Cl.
*A63B 21/00* (2006.01)
*A63B 21/02* (2006.01)
(Continued)

(52) U.S. Cl.
CPC ..... *A63B 23/0211* (2013.01); *A63B 21/068* (2013.01); *A63B 21/4035* (2015.10); *A63B 21/4045* (2015.10); *A63B 22/201* (2013.01); *A63B 23/0227* (2013.01); *A63B 23/0238* (2013.01); *A63B 23/03525* (2013.01); *A63B 21/0442* (2013.01); *A63B 21/0552* (2013.01); *A63B 21/4034* (2015.10); *A63B 22/0023* (2013.01); *A63B 22/203* (2013.01); *A63B 23/1209* (2013.01); *A63B 23/1245* (2013.01); *A63B 2022/0028* (2013.01);
(Continued)

(58) Field of Classification Search
CPC . A63B 23/0211; A63B 23/02; A63B 23/0205; A63B 23/0216; A63B 23/0222; A63B 23/0227; A63B 23/12; A63B 23/1209; A63B 23/1236; A63B 22/20; A63B 22/201; A63B 22/203; A63B 22/205; A63B 22/208; A63B 21/068; A63B 21/40; A63B 21/4023; A63B 2022/0025; A63B 2022/0028; A63B 2022/0035
See application file for complete search history.

(56) References Cited

U.S. PATENT DOCUMENTS 1,984,165 A 12/1934 Tolchin
2,129,262 A 5/1938 Cole
(Continued)

FOREIGN PATENT DOCUMENTS

WO 9409858 A1 5/1994

*Primary Examiner* — Nyca T Nguyen
(74) *Attorney, Agent, or Firm* — Yancy IP Law, PLLC

(57) ABSTRACT

The exercise device includes an elevated base, including a single track, diverging forwardly into a plurality of elevated arms, each including an elongated track member disposed between opposing first and second ends such that the first end is proximal to a forward end of the elevated base. An elevated beam provided with a stationary knee support protrudes rearwardly from the elevated base. A single slider including a steering mechanism is capable of being slidably disposed on the single track and selectively disposed onto an elongated track member of any one of the plurality of elevated arms. Preferably, a plurality of legs are used to elevate the plurality of elevated arms, elevated base and elevated beam from a supporting surface.

10 Claims, 9 Drawing Sheets

(51) Int. Cl.

| | |
|---|---|
| ***A63B 23/02*** | (2006.01) |
| ***A63B 21/068*** | (2006.01) |
| ***A63B 22/20*** | (2006.01) |
| ***A63B 23/035*** | (2006.01) |
| *A63B 23/00* | (2006.01) |
| *A63B 21/055* | (2006.01) |
| *A63B 22/00* | (2006.01) |
| *A63B 23/12* | (2006.01) |
| *A63B 21/04* | (2006.01) |
| *A63B 71/00* | (2006.01) |

(52) U.S. Cl.

CPC ... *A63B 2022/206* (2013.01); *A63B 2023/003* (2013.01); *A63B 2071/0072* (2013.01); *A63B 2071/0081* (2013.01); *A63B 2208/0219* (2013.01); *A63B 2225/09* (2013.01); *A63B 2225/093* (2013.01)

(56) References Cited

U.S. PATENT DOCUMENTS 4,171,805 A 10/1979 Abbott
4,176,836 A 12/1979 Coyle
4,387,893 A 6/1983 Baldwin
4,468,025 A 8/1984 Sferle
4,679,786 A 7/1987 Rodgers
5,518,483 A 5/1996 Oswald
5,620,403 A 4/1997 Lundin
5,669,865 A 9/1997 Gordon
5,904,641 A * 5/1999 Huang ..... A61H 1/0244 482/131
6,048,293 A 4/2000 Lee
D425,585 S 5/2000 Wu
6,071,217 A 6/2000 Barnett
6,440,045 B1 * 8/2002 Gaston ..... A63B 21/012 482/140
7,128,702 B2 10/2006 Boland et al.
7,229,394 B1 6/2007 Tyree
7,232,404 B2 6/2007 Nelson
D565,134 S 3/2008 Brown et al.
7,591,773 B2 9/2009 Weir et al.
7,608,031 B2 10/2009 Kerry
7,658,701 B2 2/2010 Webb et al.
7,691,041 B2 4/2010 Abdo
7,780,585 B1 8/2010 Rivas
7,794,376 B2 9/2010 Chou
7,846,080 B2 12/2010 Boren
7,867,149 B1 1/2011 Webber et al.
7,963,895 B2 6/2011 Nohejl
8,043,199 B1 * 10/2011 Barker ..... A63B 22/0023 482/132
8,118,718 B2 2/2012 Brodess et al.
8,118,720 B2 2/2012 Sebastian
8,172,732 B1 5/2012 Webber et al.
8,308,620 B2 11/2012 Lyszczarz
8,317,665 B2 11/2012 Webber et al.
8,323,160 B2 12/2012 Splane
8,480,548 B2 7/2013 Gerschefske
8,500,611 B2 8/2013 Hoffman
8,562,492 B2 10/2013 Gerschefske et al.
9,017,236 B1 * 4/2015 Aviles ..... A63B 23/0211 482/132
9,265,986 B1 * 2/2016 Godak ..... A63B 21/1488
2006/0116262 A1 6/2006 Pandozy
2007/0149370 A1 6/2007 Brown et al.
2007/0213184 A1 9/2007 Habing et al.
2007/0287618 A1 12/2007 Verheem
2008/0070766 A1 * 3/2008 Brown ..... A63B 21/068 482/140
2010/0022367 A1 1/2010 McBride et al.
2010/0048367 A1 * 2/2010 Liang ..... A63B 21/154 482/130
2010/0317497 A1 12/2010 Nadim
2011/0077136 A1 * 3/2011 Tozzi ..... A63B 22/203 482/141
2011/0275498 A1 * 11/2011 Brodess ..... A63B 21/0428 482/140
2011/0294633 A1 * 12/2011 Esrick ..... A63B 21/00069 482/139
2012/0115695 A1 5/2012 Watterson et al.
2012/0225759 A1 * 9/2012 Tsai ..... A63B 21/0726 482/131
2012/0277069 A1 11/2012 Hockridge et al.
2012/0295771 A1 11/2012 LaGree
2013/0109538 A1 * 5/2013 Ho ..... A63B 71/0622 482/8
2013/0123083 A1 5/2013 Sip
2013/0331238 A1 12/2013 Ellis

* cited by examiner

SLIDING EXERCISE DEVICE WITH A PLURALITY OF TRACKS

CROSS-REFERENCE TO RELATED APPLICATIONS

This application claims the benefit, under 35 U.S.C. 119(e), of U.S. Provisional Application No. 61/936,714 filed Feb. 6, 2014, the contents of which are incorporated herein by reference.

BACKGROUND OF THE INVENTION

1. Field of the Invention

The present invention relates generally to an exercise device that utilizes a plurality of sliding and pivoting motions for the purpose of exercising various muscles, such as the abdominal muscles.

2. Description of Related Art

Various exercising equipment and equipment free methods of exercising have been developed for exercising the abdominal muscles. Abdominal muscles are generally difficult to isolate and strengthen. Many hours and years of exercise are generally necessary to produce a significant effect on the abdominal musculature. Exercising these muscles may create strain and pressure on the back and neck muscles, depending on the technique used. Additionally, failure to maintain consistent and proper alignment while exercising the abdominal muscles may result in an ineffective workout as well as injury.

Generally, exercise devices are known in the art that provide a framework for individuals to extend their upper torsos from a kneeling position to a prone position in order to strengthen and stretch various muscle groups of the upper torso. A typical apparatus would include a sliding member that could be propelled along a sliding surface by the user stretching the user's body from a kneeling to a prone position, and vice-versa.

Known exercise devices are limited in several respects. For example, prior art devices did not provide adjustable resistance by elevating a track on which the sliding member maneuvered. Additionally, such prior devices were not adaptable to provide an exercise regime particularly and individually directed to the muscles groups of the arms, chest, or legs. Generally these devices are limited in that they include a single track with which the user stretches back and forth. Thus, only a certain set of muscles are isolated for strengthening and performance.

What is needed is a push-pull type exercise device that overcomes the above shortcomings. The invention should permit a large number of body parts to be exercised. Furthermore, the exercise device should be comfortable.

BRIEF SUMMARY OF THE INVENTION

The exercise device in accordance with the present invention includes an elevated base that diverges forwardly into a plurality of elevated arms. The elevated base has a single track disposed thereon and each of the elevated arms includes an elongated track member disposed between opposing first and second ends such that said first end is proximal to a forward end of the single track provided on the elevated base. An elevated beam protrudes rearwardly from the elevated base. The elevated beam has a stationary knee support provided thereon. A single slider including a steering mechanism is slidably disposed on the single track and selectively onto an elongated track member of any one of the plurality of elevated arms. Preferably, a plurality of legs are used to elevate the plurality of elevated arms, elevated base and elevated beam from a surface by a distance of at least three inches.

The present exercise device mostly works the abdominal and oblique muscles in addition to chest, back, gluteus, triceps and shoulders. The exercise device is preferably designed with three elevated arms including three elongated track members. In a preferred embodiment, the exercise device is elevated above the surface approximately 12-20 inches and is supported by 5-6 legs.

Generally, the present exercise device utilizes a person's own body weight and strength to perform the exercises. In a knee bent position, the user rolls the single slider forward and backward between the single track and the selected elongated track member. The present exercise device keeps abdominal and other body muscles firm and in shape.

BRIEF DESCRIPTION OF THE SEVERAL VIEWS OF THE DRAWINGS

The features and advantages of the present invention will become apparent from the following detailed description of a preferred embodiment thereof, taken in conjunction with the accompanying drawings, in which.

DETAILED DESCRIPTION OF THE INVENTION

Figure 1:
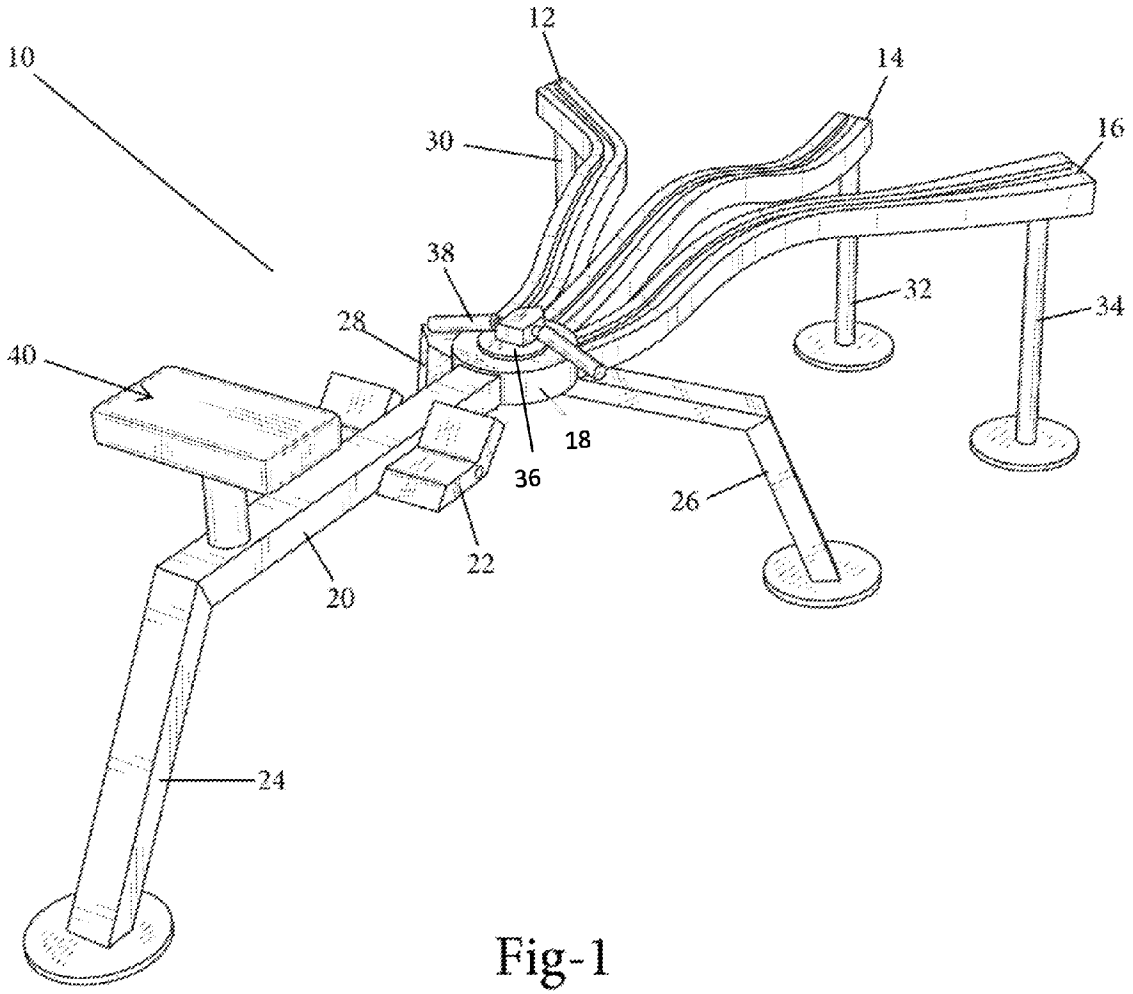
FIG. 1 is a perspective view of an exercise device in accordance with one embodiment of the present invention.
Figure 2:
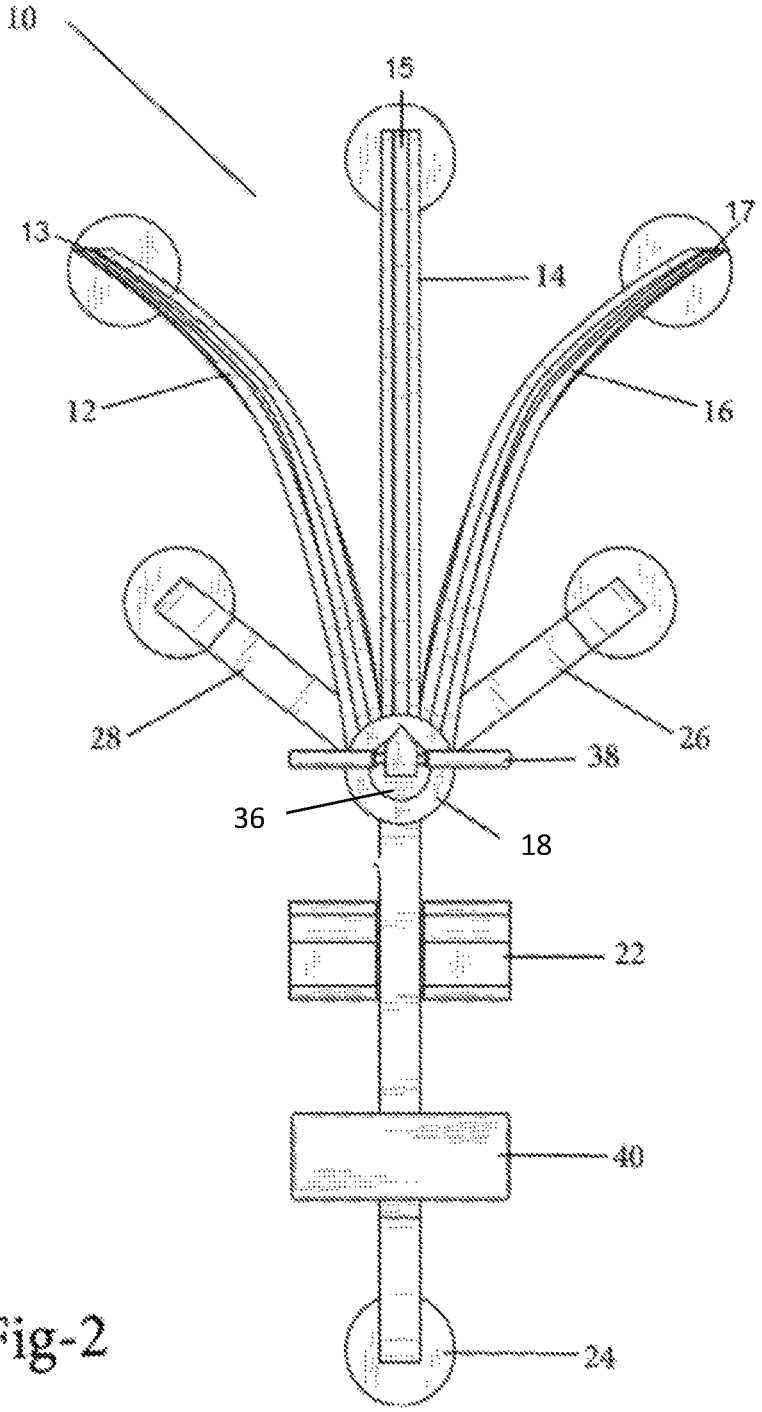
FIG. 2 is a top view of the exercise device of FIG. 1 in accordance with one embodiment of the present invention.
Figure 3:
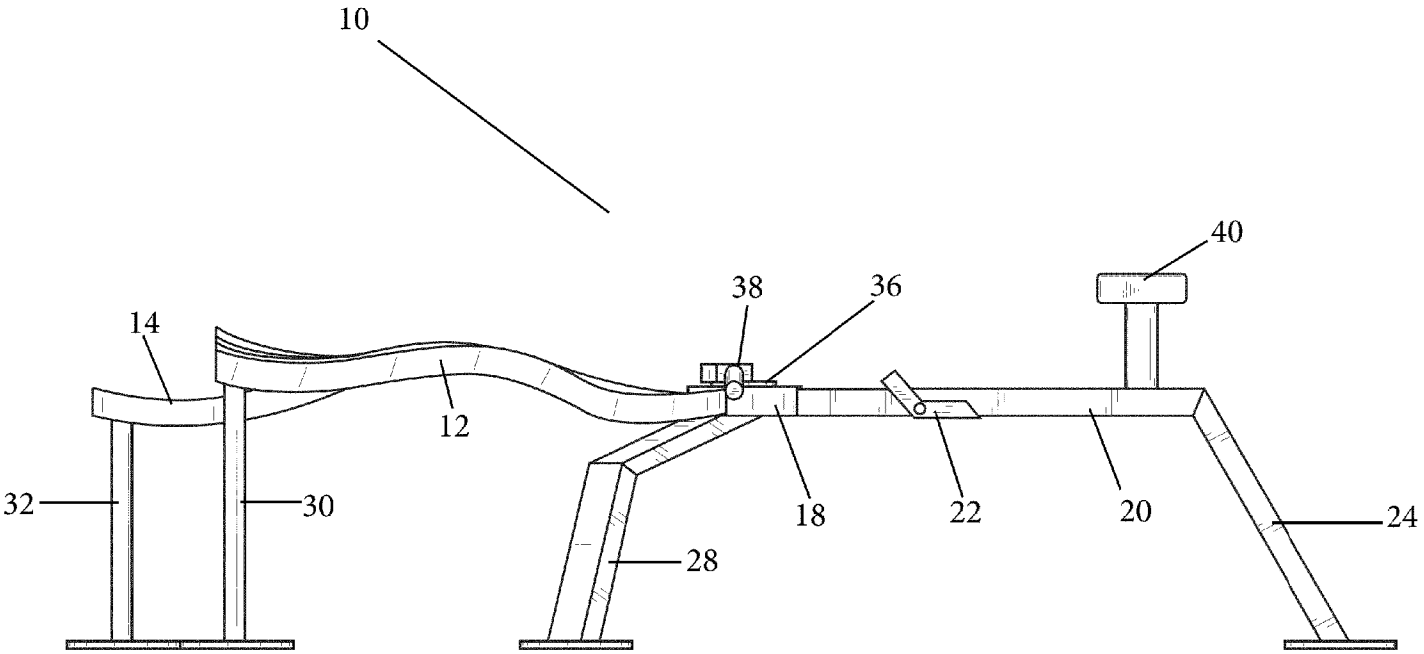
FIG. 3 is a left-side view of the exercise device of FIG. 1 in accordance with one embodiment of the present invention.
Figure 4:
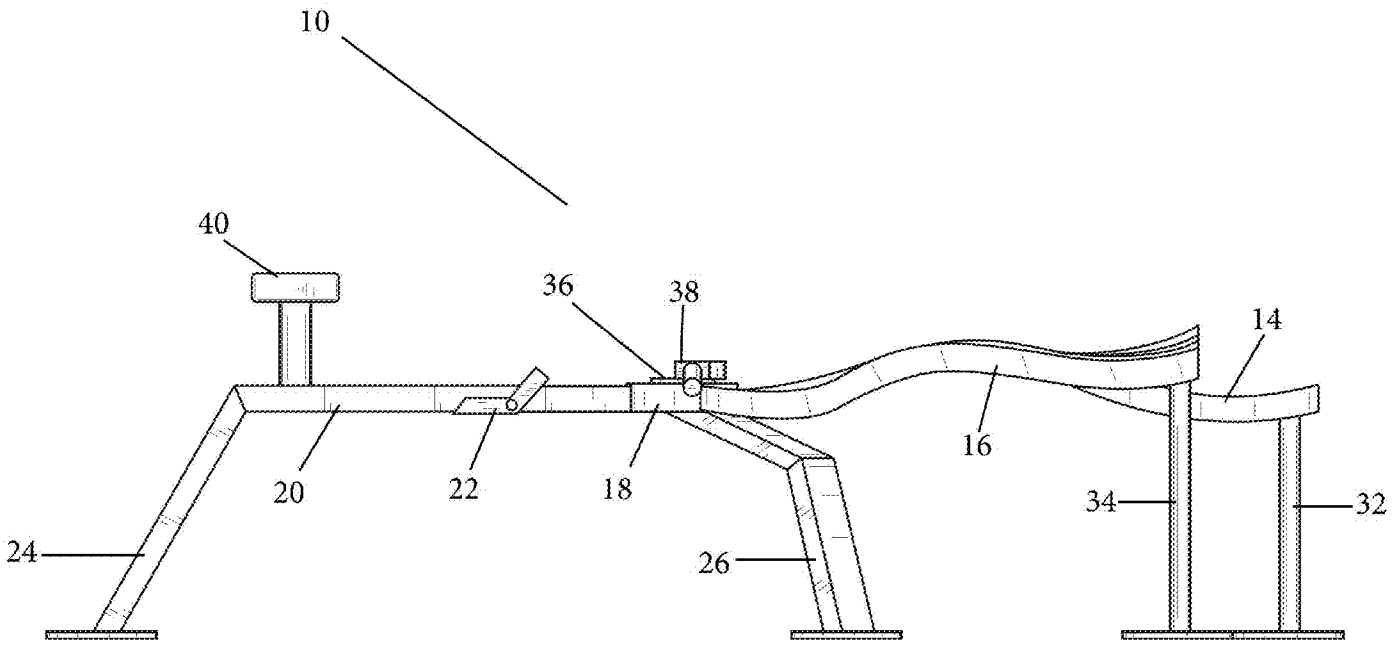
FIG. 4 is a right-side view of the exercise device of FIG. 1 in accordance with one embodiment of the present invention.
Figure 5:
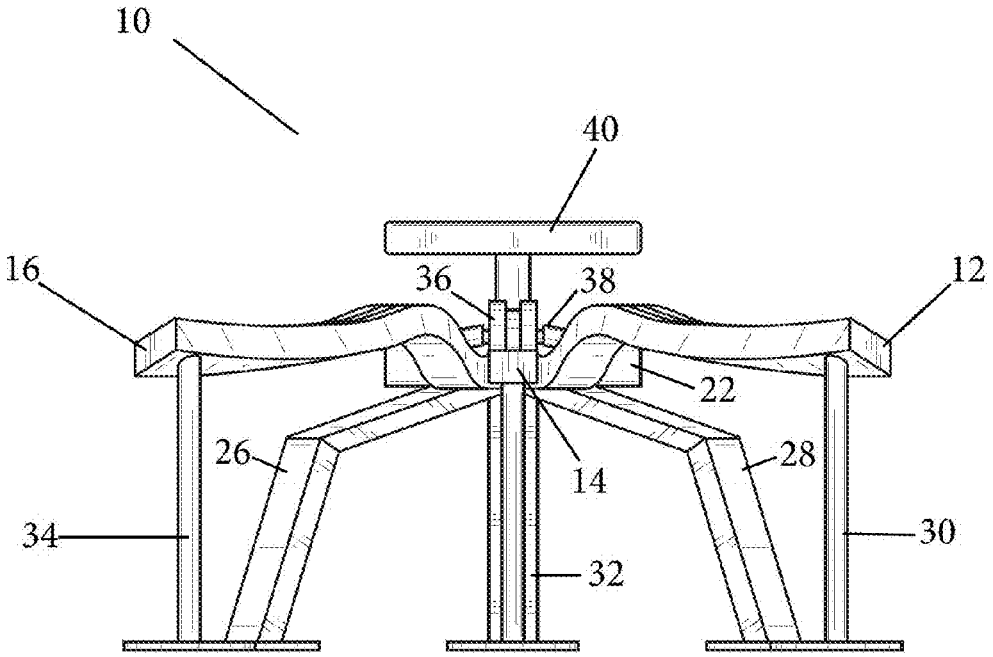
FIG. 5 is a front view of the exercise device of FIG. 1 in accordance with one embodiment of the present invention.
Figure 6:
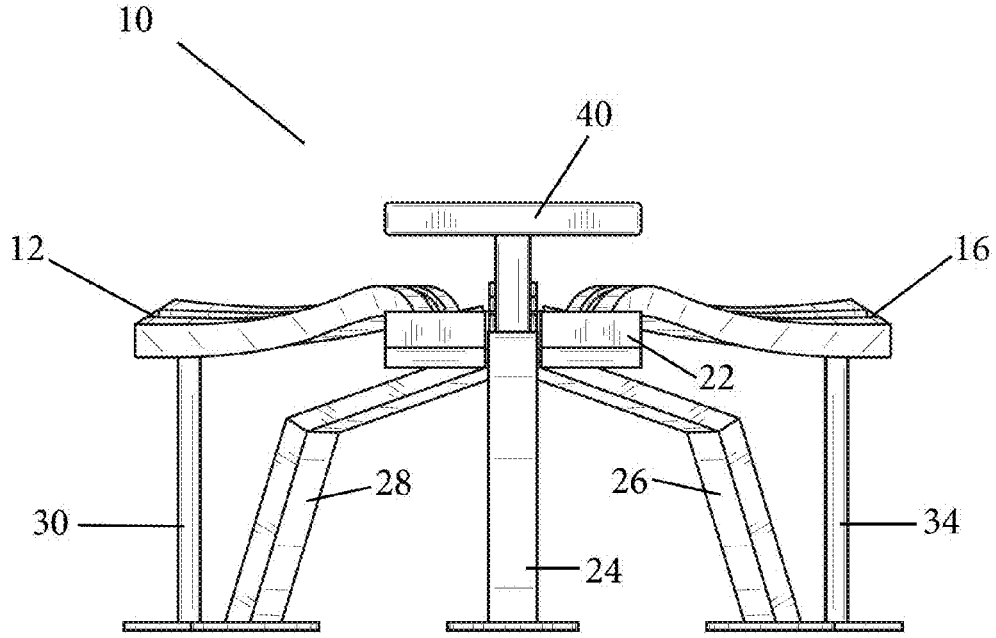
FIG. 6 is a rear view of the exercise device of FIG. 1 in accordance with one embodiment of the present invention.

FIGS. 1-6 shows an exercise device 10 in accordance with one embodiment of the present invention including a plurality of elevated arms 12, 14, 16 diverging forwardly from an elevated base 18. The elevated base has a single track disposed thereon and each of the elevated arms 12, 14, 16 includes an elongated track member disposed between opposing first and second ends such that the first end is proximal to a forward end of the single track provided on the elevated base 18. While FIGS. 1-6 show a preferred embodiment of the present invention including three elevated arms 12, 14, 16, it will be understood by those of skill in the art that two or more elevated arms may be provided in accordance with the present invention. An elevated beam 20 protrudes rearwardly from the elevated base 18 and includes a stationary knee support 22 provided thereon. It should be understood to those of skill in the art that the elevated base 18 may be continuous with the elevated beam 20 such that there is no discernable separation of the elevated base 18 and the elevated beam 20. As provided in FIGS. 1-6, the elevated base 18 is the forward end of the elevated beam 20. The plurality of elevated arms, elevated base and elevated beam are preferably supported using a plurality of legs 24, 26, 28, 30, 32, 34. It will be understood to those of skill in the art that the plurality of legs 24, 26, 28, 30, 32, 34 may be extendable such that the length of the legs may be adjusted to alter the height of the exercise device 10 from a supporting surface (e.g. the ground). Additionally, the plurality of elevated arms 12, 14, 16 may be supported on extendable legs proximal to the second end of each elongated track member to provide for an incline and/or decline to the elongated track member. A single slider 36 including a steering mechanism 38 is slidably disposed on the single track and selectively onto an elongated track member of any of the plurality of elevated arms 12, 14, 16. The steering mechanism 38, such as a handle, allows the user to guide the slider 36 to a selected elongated track member. The terms "slider" and "slidably" are used generally as providing for smooth movement along a surface in continual contact with it including, but not limited to, u-shaped roller and other bearings. FIG. 1 shows one embodiment of the present invention wherein the elongated track member includes a channel for receiving a wheel member, or other protuberance, from the single slider 36 for selectively sliding the single slider 36 along the length of the elongated track from the first end to/from the second end of any one of the plurality of elevated arms 12, 14, 16. FIG. 1 also provides a bench 40 as an optional component to be provided to the exercise device 10 on which the user may sit to rest.

Figure 7:
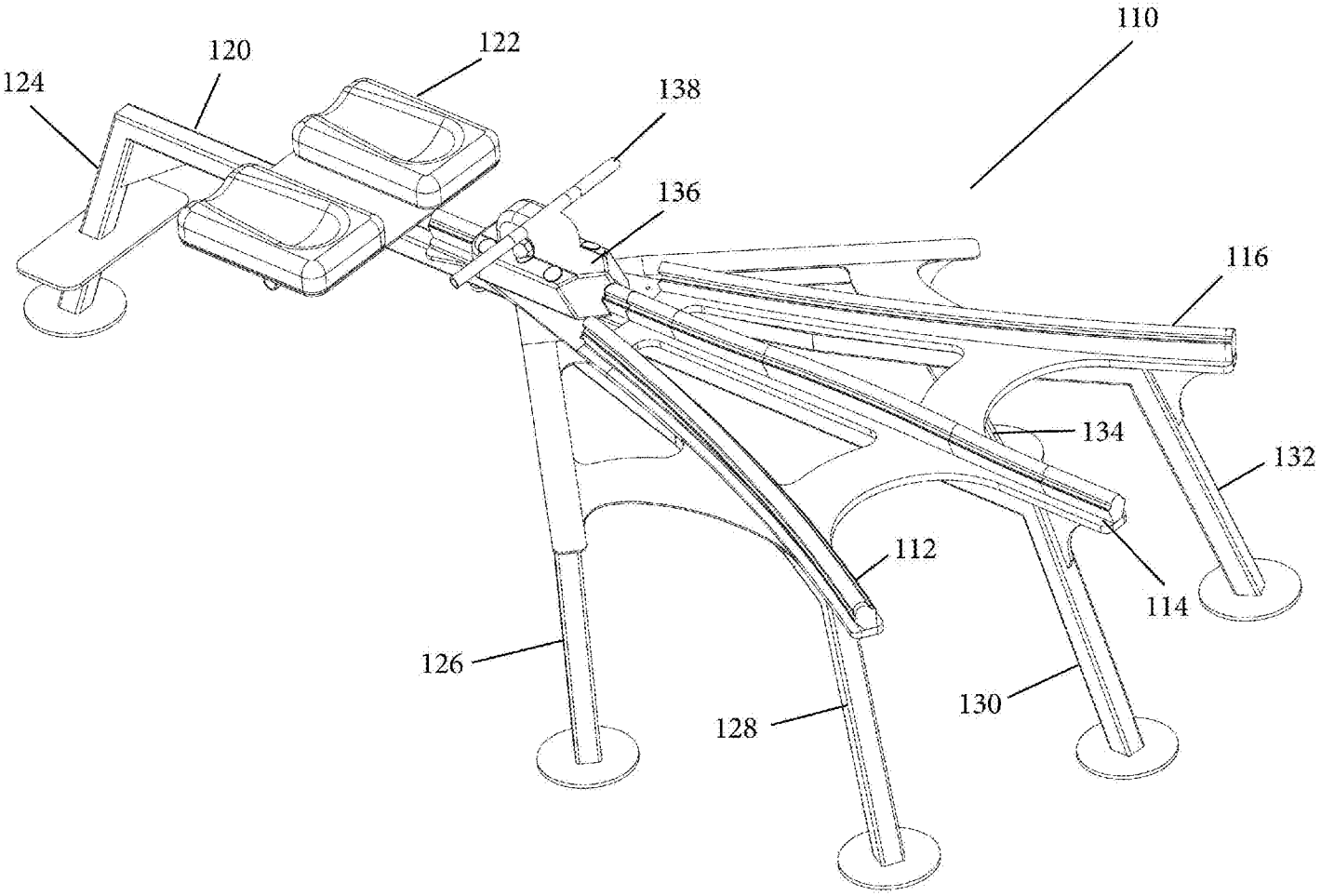
FIG. 7 is a perspective view of an alternate embodiment of the exercise device in accordance with one embodiment of the present invention.
Figure 8:
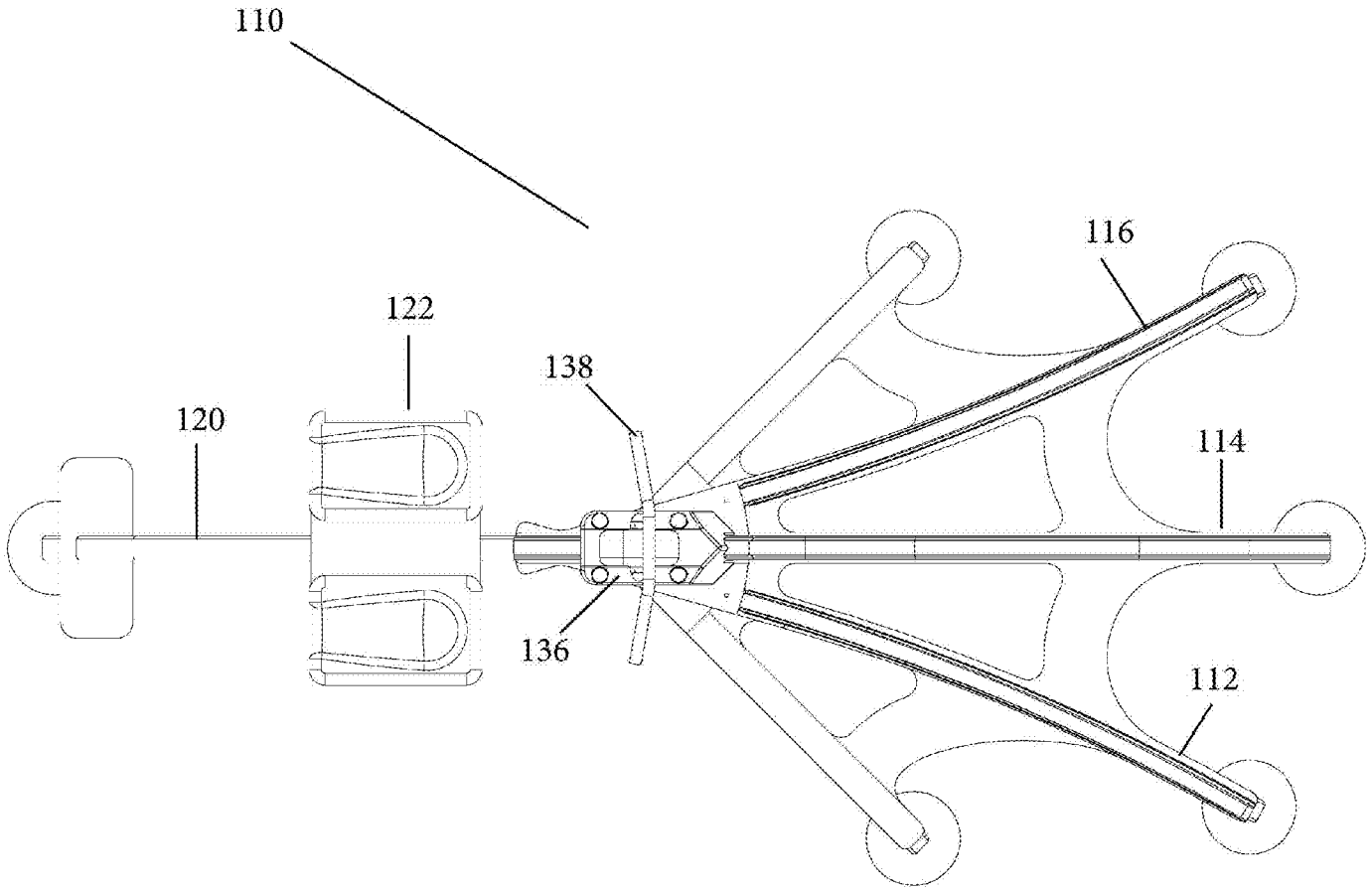
FIG. 8 is a top view of the exercise device of FIG. 7 in accordance with one embodiment of the present invention.
Figure 9:
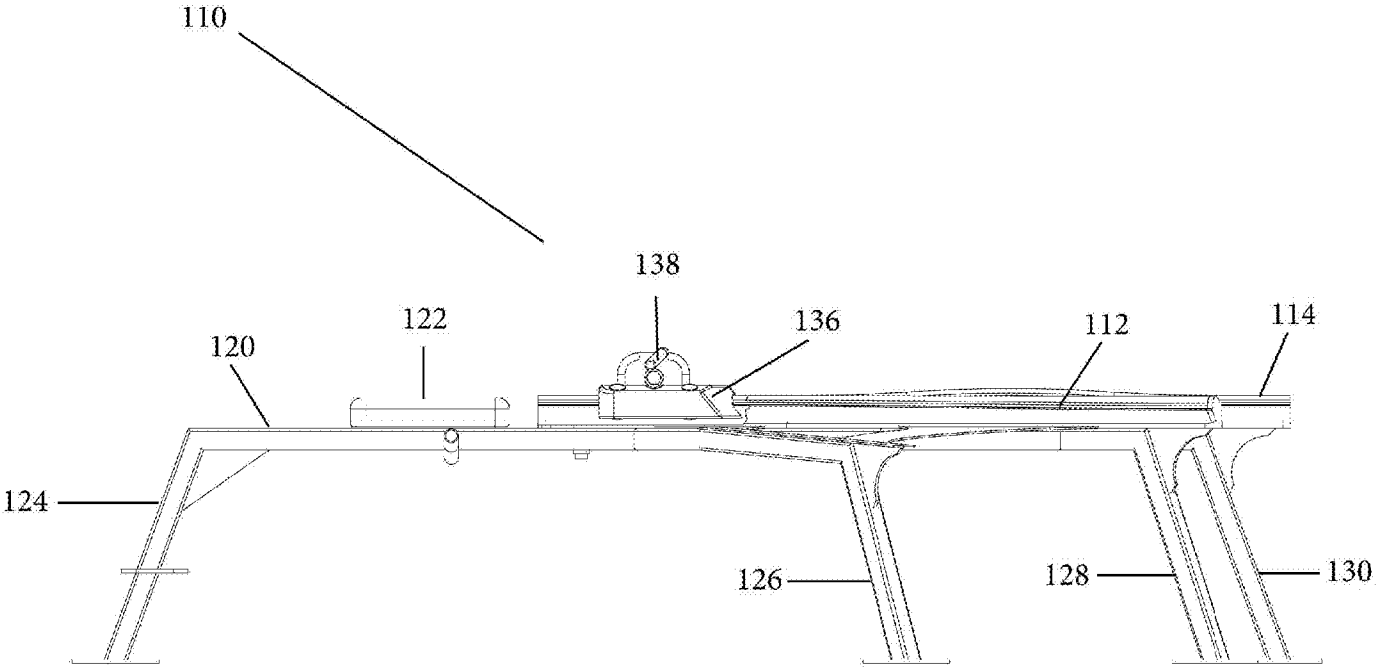
FIG. 9 is a side view of the exercise device of FIG. 7 in accordance with one embodiment of the present invention.
Figure 10:
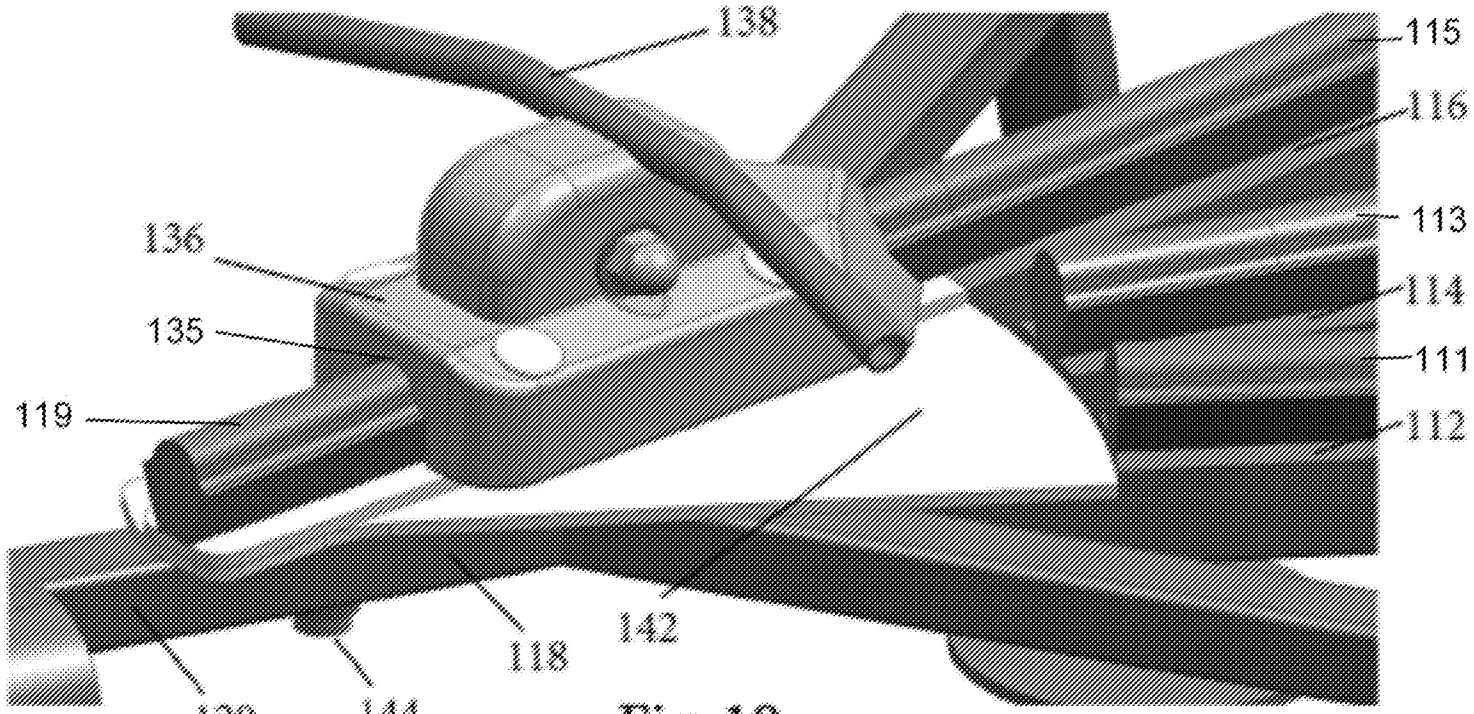
FIG. 10 is a magnified view of the exercise device of FIG. 7 in accordance with one embodiment of the present invention.

FIGS. 7-9 shows an exercise device 110 in accordance with another embodiment of the present invention including a plurality of elevated arms 112, 114, 116 diverging forwardly form an elevated base 118. The elevated base 118 has a single track 119 disposed thereon and each of the elevated arms 112, 114, 116 each includes an elongated track member 111, 113, 115 disposed between opposing first and second ends such that the first end is proximal to a forward end of the single track provided on theelevated base 118. An elevated beam 120 protrudes rearwardly from the elevated base 118 and includes a stationary knee support 122 provided thereon. As seen in this embodiment, the elevated base 118 is continuous with the elevated beam 120 such that there is no discernable separation of the elevated base 118 and the elevated beam 120. The plurality of elevated arms, elevated base and elevated beam are preferably supported by a plurality of legs 124, 126, 128, 130, 132, 134. It is understood that more or less legs may be provided depending on the stability required for the exercise device 10, 110. Also, it should be understood to those of skill in the art that the plurality of legs 124, 126, 128, 130, 132, 134 may be extendable. Additionally, the plurality of elevated arms 112, 114, 116 may be supported on extendable legs proximal the second end of each elongated track member to provide for an incline and/or decline to the elongated track member. A single slider 136 including a steering mechanism 138 is slidably disposed on the single track and selectively onto an elongated track member of any of the plurality of elevated arms 112, 114, 116. In this embodiment, the exercise device 110 includes a single slider 136 having one roller bearing on the top of the single track and/or elongated track member with four other bearings on the underside therof. The steering mechanism 138 allows the user to guide the single slider 136 to a selected elongated track member. FIG. 10 shows one embodiment of the present invention wherein the single track 119 and each of the elongated track members 111, 113, 115 includes an elongated post member to be received within a recess 135 provided in the single slider 136 for selectively sliding the single slider 136 from the single track 119 along the length of the elongated track to/from the first and second end of any one of the elongated track members 111, 113, 115. In this preferred embodiment, each of the elongated post members has the same, or substantially the same, cross-sectional area in order to slidably fit within the recess 135 provided by the single slider 136. Also, in this embodiment, the elongated track members are not continuous with the single track. However, in this embodiment, the single track 119 is provided such that it extends forwardly toward the first end of each of the elongated track members 111, 113, 115 such that said single slider may be smoothly conveyed from said single track 119 to any of said elongated track members 111, 113, 115. In the embodiment provided in FIG. 10, the single track 119 is provided on a swivel platform 142 pivotally connected to the elevated base 118 at pivot point 144. The pivot point 144 allows the single slider 136 to be steered into any one of the elongated track members 111, 113, 115 on the plurality of elevated arms 112, 114, 116. In this embodiment, the swivel platform 142 rests on a spring loaded bearing that the single slider 136 falls into so that the single track 119 is firmly retained in a position adjacent to the first end of a selected elevated track member.

Preferably, the only moving element during use of the exercise device 10, 110 is the single slider 36, 136. However, the legs may be extended prior/after use to adjust the height of the exercise device from the support surface. In one embodiment, the legs are extended such that the plurality of elevated arms, elevated base and elevated beam are supported by a distance of at least three inches from a support surface (e.g. floor or ground), more preferably a distance of 12-20 inches from the support surface. In a preferred embodiment including three elevated arms, 5-6 legs are used to support the elevated arms, elevated base and elevated beam. It is also possible to adjust the position of the stationary knee support 22, 122 before/after use of the exercise device. However, it is preferred that the stationary knee support 22, 122 does not move during the use of the exercise device.

Optionally ancillary devices may be attached to the exercise device 10, 110 to provide ease of use and/or improved performance. For example, an Achilles support may outwardly extend from the raised beam 20, 120 near the leg 24, 124. Also, a waist strap may be suspended from a member extending upwardly from the raised beam 20, 120 near the leg 24, 124 such that it extends over the stationary knee support 22, 122. Furthermore, resistance bands may be connected to the single slider 36, 136 along any one of the elongated track members, or each elongated track member. In a preferred embodiment, the steering mechanism 38, 138 may include a miniature finger or thumb brake.

Although the present invention has been disclosed in terms of a preferred embodiment, it will be understood that numerous additional modifications and variations could be made thereto without departing from the scope of the invention as defined by the following claims.

I claims:

1. An exercise device comprising:

an elevated base diverging forwardly into a plurality of elevated arms; wherein said elevated base includes a single track, and each elevated arm includes an elongated track member having opposing first and second ends such that said first end is proximal to a forward end of said single track;

an elevated beam protrudes rearwardly from said elevated base; wherein said elevated beam includes a stationary knee support provided thereon; and a single slider including a steering mechanism; wherein said single slider is configured to be slidably disposed on said single track and selectively disposed onto an elongated track member of any one of the plurality of elevated arms and wherein said elongated track members are discontinuous with said single track such that said forward end of said single track extends forwardly toward any of said first ends of said elongated track members such that said single slider is configured to smoothly be conveyed from said single track to any of said elongated track members.

2. The exercise device of claim 1, wherein said plurality of elevated arms, said elevated base and said elevated beam are supported at a distance of at least three inches from a supporting surface using a plurality of legs.

3. The exercise device of claim 2, wherein each of said plurality of elevated arms is supported by a leg of said plurality of legs located proximal to the second end of each elongated track member.

4. The exercise device of claim 3, wherein said elevated base is supported by two legs of said plurality of legs.

5. The exercise device of claim 4, wherein said elevated beam is supported by a single leg of said plurality of legs at a location distal from said elevated base.

6. The exercise device of claim 2, wherein said distance is 12-20 inches from the supporting surface.

7. The exercise device of claim 1, wherein each of said elongated track members and said single track each are an elongated post having the same cross-sectional area.

8. The exercise device of claim 7, wherein said single slider has a recess dimensioned to slidably receive each of said elongated post.

9. The exercise device of claim 1, wherein said plurality of elevated arms is at least three elevated arms.

10. The exercise device of claim 9, wherein said plurality of elevated arms is three elevated arms.

* * * * *